US006327830B1

(12) United States Patent
Hecht et al.

(10) Patent No.: US 6,327,830 B1
(45) Date of Patent: Dec. 11, 2001

(54) STRUCTURAL MEMBER WITH ALIGNING MEANS FOR A MATING PART

(76) Inventors: Thomas R. Hecht, 37 Hemlock Acres, Manheim, PA (US) 17545; Howard F. Livingston, 1333 Beaconfield La., Lancaster, PA (US) 17601

( * ) Notice: Subject to any disclaimer, the term of this patent is extended or adjusted under 35 U.S.C. 154(b) by 0 days.

(21) Appl. No.: 09/455,309

(22) Filed: Dec. 6, 1999

(51) Int. Cl.[7] ..... E04H 12/22

(52) U.S. Cl. ..... 52/655.1; 52/702; 52/704; 52/736.2; 403/230; 256/65

(58) Field of Search ..... 52/655.1, 704, 52/702, 736.2, 737.2, 737.3, 737.5; 211/182; 403/230, 298; 256/65, 70

(56) References Cited

U.S. PATENT DOCUMENTS 2,406,078 * 8/1946 Hushower ..... 403/230 X
2,817,423 * 12/1957 Dye et al. ..... 403/230 X
2,931,129 * 4/1960 Boniface ..... 211/182 X
4,355,725 * 10/1982 Humphrey ..... 211/182 X
4,474,299 * 10/1984 Andrews ..... 211/182 X
4,758,111 * 7/1988 Vitta ..... 52/655.1 X
5,560,588 * 10/1996 Hilliard ..... 256/65

* cited by examiner

*Primary Examiner*—Carl D. Friedman
*Assistant Examiner*—Brian E. Glessner
(74) *Attorney, Agent, or Firm*—Dykema Gossett PLLC

(57) ABSTRACT

A rigid body has at least one hole formed therein for receiving a piece of lumber of rectangular cross-section. The hole is rectangular in cross-section to form two long sides and two short sides of the hole, with a longitudinal axis extending through the hole. Three ribs are provided which project into the hole and extend parallel with the axis of the hole. A first rib is formed at the midpoint of one of the long sides of the hole; and a second rib is formed at the midpoint of the other one of the long sides of the hole. A third rib is formed at the midpoint of one of the short sides of the hole. An opening is formed through the one short side of the hole. When the piece of lumber is disposed within the hole in the body, a fastener such as a screw extends through the opening and into the piece of lumber to fasten the body to the piece of lumber.

8 Claims, 4 Drawing Sheets

STRUCTURAL MEMBER WITH ALIGNING MEANS FOR A MATING PART

CROSS-REFERENCE TO RELATED PATENT APPLICATION

The present application claims the benefit of the priority date of U.S. patent application Ser. No. 29/103,042, filed Apr. 7, 1999.

BACKGROUND OF THE INVENTION

The present invention relates to a structural member with aligning means for a mating part, and more particularly to a rigid body formed of a hard material having at least one hole therein for receiving a mating part formed of a material such as wood which is softer than the material of the body. The hole includes alignment means for properly aligning the mating part relative to the body.

The invention is especially adapted for use with pieces of wood such as conventional "2×4 lumber", wherein the lumber has a rectangular cross-section. The rigid body may comprise a component of shelving utilizing 2×4 lumber such as disclosed in U.S. Design patent application Ser. No. 29/103,042, the disclosure of which is incorporated herein by reference. The rigid body may also comprise a component of a convertible bench and table top assembly as disclosed in U.S. Pat. No. 4,913,488, the disclosure of which is incorporated herein by reference. The invention can be employed in other types of construction wherein it is desired to interconnect a rigid body with a mating part which is formed of material which is softer than that of the rigid body.

The original design of the rigid body for use with shelving is disclosed in U.S. Design patent application Ser. No. 29/091,633, the disclosure of which is incorporated herein by reference. In this original design, rectangular holes were provided which were oversized for receiving pieces of lumber therein which were secured in place by screws. It is common knowledge that lumber, while milled to a specific dimensional size, does not maintain its dimensions and shape when exposed to the environment, resulting in the lumber swelling, bowing, twisting and cupping. The oversized rectangular holes were intended to provide clearance for the changes in size and shape of the lumber which occurs in the normal course of events, without introducing stress into the rigid body. The rigid body and piece of lumber were assembled by the use of a single screw extending through one long side of a hole and a single screw extending through one short side of a hole, effectively pulling the lumber into contact with the sides of the hole forming one corner of the hole, which is similar to the arrangement with other commonly available brackets and the like.

This original design proved to be unacceptable. Since the rigid body may be, for example, either a metallic casting or a molded plastic, it is necessary to provide relief angles or "draft" for the large rectangular openings so that the molded or cast body can be effectively released from the mold. Such relief angles make it difficult to properly align the lumber so that it extends perpendicular to the body as is desired. Furthermore, the average amount of clearance between most lumber and the sides of the holes afforded movement and/or deflection of the non-contacting sides of the lumber, which resulted in twisting and misalignment of the rigid body relative to the lumber. Therefore, the assembled rigid bodies and lumber are not sufficiently stable. This is a common problem with these types of assemblies, and manufacturers often suggest the use of additional components for cross-bracing the assemblies.

SUMMARY OF THE INVENTION

The present invention incorporates one or more holes which are slightly larger than the nominal dimensions of a piece of lumber to accept the variations in the dimensions of the lumber, and the holes in the rigid body are provided with means for positively properly aligning a piece of lumber relative to the body so that the lumber will be perpendicular to opposite sides of the body.

It is apparent that the invention may be employed with a rigid body having a single hole therein, or a body having a multiplicity of holes therein. In either case, each hole is generally rectangular in cross-section as is the mating part such as a piece of 2×4 lumber. The hole has two long sides and two short sides, with a longitudinal axis extending through the hole. Three ribs are provided which project into the hole and extend generally parallel with the axis of the hole. A first rib is formed at the midpoint of the one of the long sides of the hole; and a second rib is formed at the midpoint of the other one of the long sides of the hole. A third rib is formed at the midpoint of one of the short sides of the hole. In a modified form of the invention, a fourth rib is formed at the midpoint of said one of the short sides of the hole.

The ribs on the rigid body are molded without draft to extend parallel with the longitudinal axis of the hole and provide three points of contact with the mating part, which, by design, automatically squares the lumber relative to the body. The body and mating part are fastened to one another by one or more screws. In the case of swollen or twisted lumber, the ribs contact and/or penetrate the softer lumber at only the three points of contact, and therefore the rigid body is more easily moved or repositioned relative to a piece of lumber without jamming within the hole such as would occur if the hole were a close fitting hole without ribs.

DESCRIPTION OF THE PREFERRED EMBODIMENTS

Figure 1:
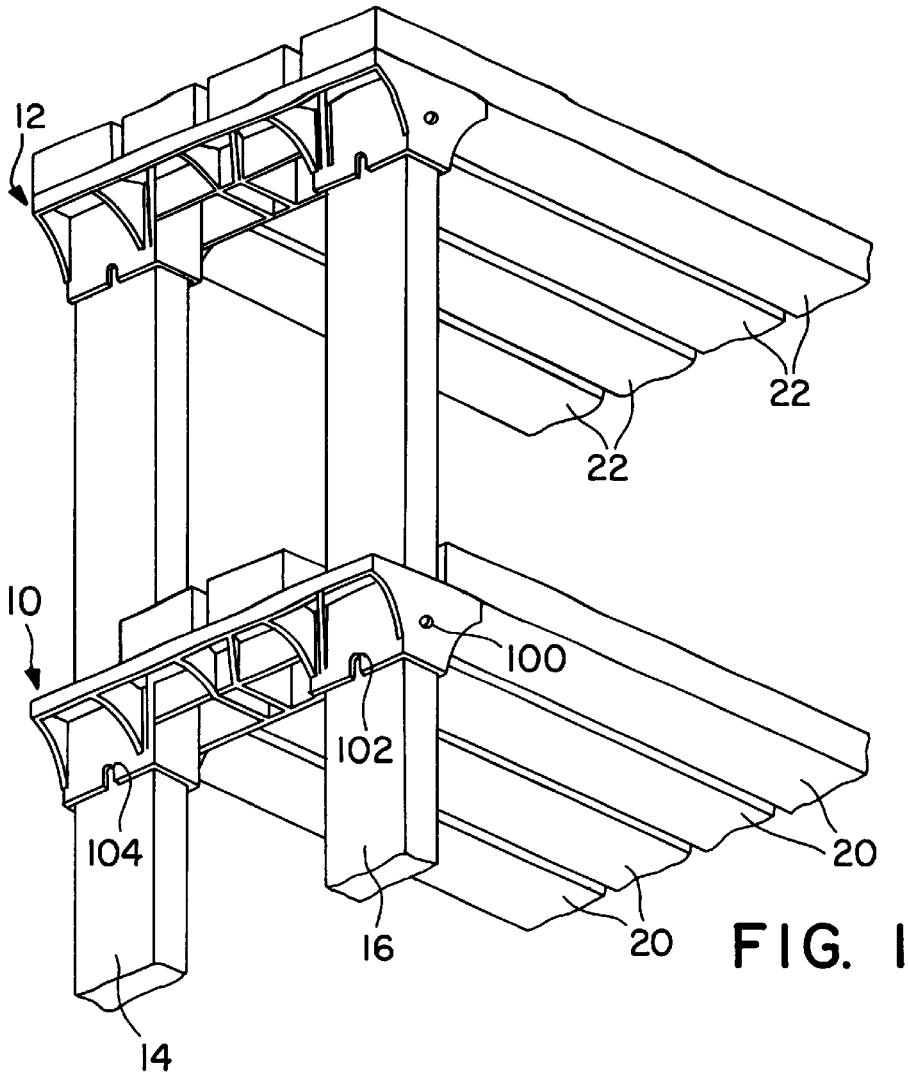
FIG. 1 is a bottom perspective view of shelving utilizing a structural member according to the invention.

Referring to the drawings wherein like reference characters designate corresponding parts throughout the several views, a first embodiment is shown in FIGS. 1–5 of the drawings. As seen in FIG. 1, shelving incorporating the present invention is illustrated including a pair of similar structural members indicated generally by reference numerals 10 and 12. A pair of vertically extending 2×4 pieces of lumber 14 and 16 extend upwardly through two holes (hereinafter described) formed in member 10 and the top ends of the pieces 14 and 16 are disposed within two holes (hereinafter described) formed in member 12. A first plurality of horizontal 2×4 pieces of lumber 20 are supported by member 10; and a second plurality of 2×4 pieces of lumber 22 are supported by member 12.

Figure 2:
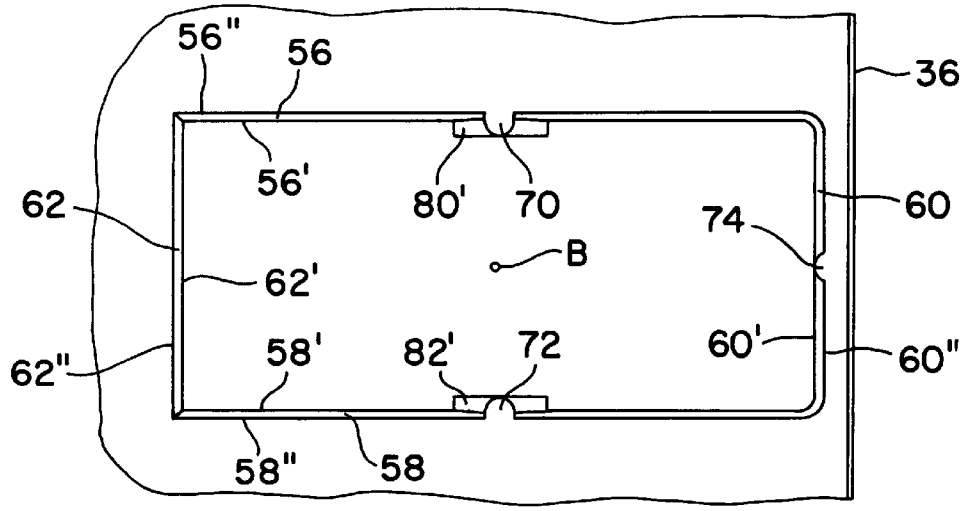
FIG. 2 is an enlarged top view of one of the holes in the structural member.
Figure 3:
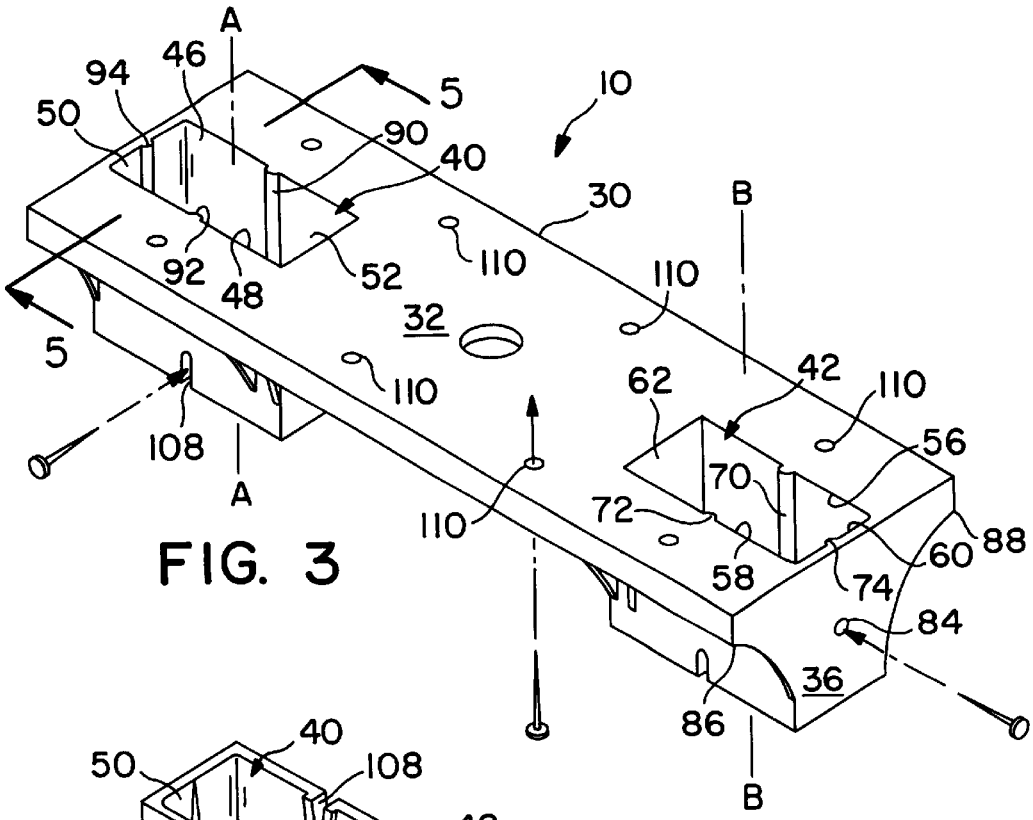
FIG. 3 is top perspective view of the structural member shown in FIG. 1.
Figure 4:
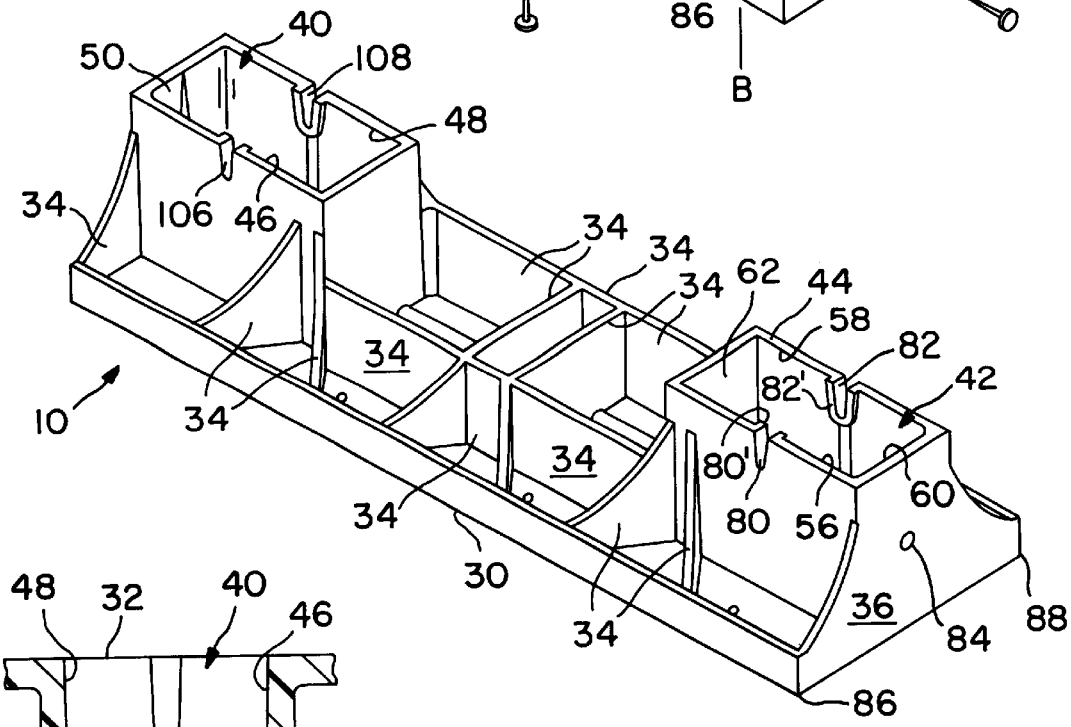
FIG. 4 is a bottom perspective view of the structural member shown in FIG. 3.

As seen in FIGS. 3 and 4, the details of construction of member 10 can be seen wherein a rigid body 30 is formed of a hard material. For example, body 30 may be a one piece metallic casting or molded plastic which is considerably harder than the lumber used therewith. The body includes a flat top surface 32 and downwardly extending webs and strengthening gussets 34 as well as opposite end faces, one of which 36 is visible if FIGS. 2 and 3. The walls also define a pair of holes 40 and 42 which extend through the body from face 32 to the bottom edge 44 of the body.

Hole 40 includes two long sides 46 and 48, and two short sides 50 and 52. Hole 42 includes two long sides 56 and 58, and two short sides 60 and 62. Long sides 46 and 48 of hole 40 are symmetrical about a longitudinal axis A-A extending through hole 40, and short sides 50 and 52 are also symmetrical about axis A-A. Long sides 56 and 58 of hole 42 are symmetrical about a longitudinal axis B-B extending through hole 42; and the short sides 60 and 62 are also symmetrical about axis.B-B.

As seen in FIG. 2, long side 56 of hole 42 has a lower edge 56' and an upper edge 56". Long side 58 has a lower edge 58' and an upper edge 58". Short side 60 has a lower edge 60' and an upper edge 60". Short side 62 has a lower edge 62' and an upper edge 62". It is therefore apparent that hole 42 has given dimensions at the lower edge of the body and that the hole tapers to a greater dimension at the upper surface 32 of the body so that each of the sides of the hole defines draft for molding or casting purposes.

A first rib 70 is disposed on long side 56 of hole 42 projects into the hole and extends parallel to axis B-B. Therefore, rib 70 has zero draft. A second rib 72 is disposed on long side 58 of hole 42 and also projects into the hole and extends parallel to axis B-B. Therefore, rib 72 has zero draft. A third rib 74 is disposed on short side 60 of the hole and projects into the hole and extends parallel to axis B-B. Therefore rib 74 has zero draft. Each of the ribs is disposed at the midpoint of the associated side of the hole. As seen in FIG. 4, a pair of openings 80 and 82 are provided in the lower edge of the long sides 56 and 58 of hole 42 for a purpose hereinafter described. Body portions 80' and 82' extend into hole 42 to provide reinforcement adjacent openings 80 and 82. Ribs 70 and 72 join body portions 80 and 82 respectively, as seen in FIGS. 2 and 4.

Another opening 84 is formed in the body and extends from end face 36 into communication with hole 42 at short side 60 of the hole. Since opening 84 is disposed substantially midway between opposite side edges 86 and 88 of the rigid body, opening 84 passes through rib 74.

Figure 5:
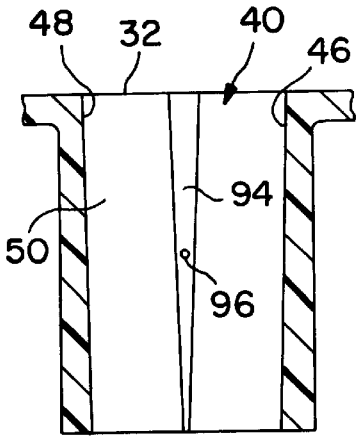
FIG. 5 is an enlarged sectional view taken on line 5—5 of FIG. 3.

Hole 40 incorporates the same construction as hole 42 and includes a pair of ribs 90 and 92 disposed on the long sides 46 and 48 respectively of the hole, and a third rib 94 is disposed on short side 50 of the hole. The remaining structure associated with hole is similar to that described in connection with hole 42, and need not be described in detail. As seen in FIG. 5, an opening 96 similar to opening 84 is provided through rib 94, and openings 106 and 108 similar to openings 80 and 82 are provided in the lower edges of long sides 46 and 48 of hole 40. Although rib 94 has a generally semicircular configuration similar to rib 74, rib 94 as well as rib 74 actually tapers from a smaller lateral dimension from the lower edge 44 of the rigid body to the top surface 32 of the body due to the draft of short side of the associated hole. Each of ribs 90, 92 and 94 has zero draft.

When pieces of lumber are inserted into holes 40 and 42, a single screw is inserted through holes 84 and 94 in the end faces of the body and screwed into the pieces of lumber to fasten the lumber to the body. If the weight applied to structural member 10 in FIG. 1 is such that a single screw 100 inserted through opening 84 might fail in shear, additional screws such as 102 and 104 may be inserted through openings 80 and 82 to provide additional support for the structural member.

Additional openings such as indicated at 110 in FIG. 3 are provided throughout the upper surface 32 of the rigid body for attaching horizontal pieces of lumber 20 to the rigid body as shown in FIG. 1.

Figure 6:
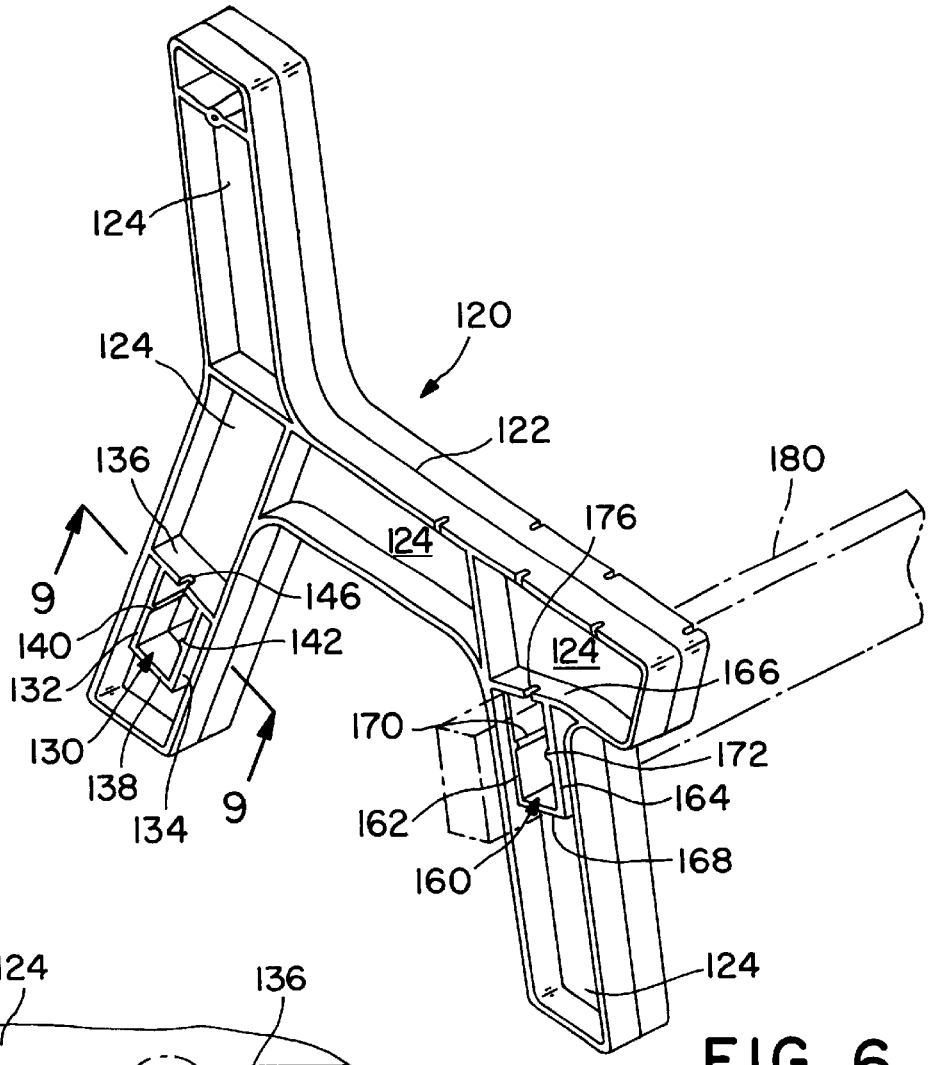
FIG. 6 is a top perspective view of a modified structural member according to the invention.

Referring now to FIGS. 6–9, another embodiment of the invention is illustrated. A rigid body in the form of a stanchion member 120 similar to stanchion member 16 shown in U.S. Pat. No. 4,913,488 for use in a convertible bench and table top assembly. This rigid body may be formed of the same material as the rigid body 30. Member 120 has a mold or casting parting line 122, a vertical web 124 being formed throughout the structure along the parting line and extending a short distance on either side of the parting line. The structure shown on one side of the web as seen in FIG. 6 is repeated on the other side of the web so that the structure on opposite sides of the web are mirror images of one another.

Figure 7:
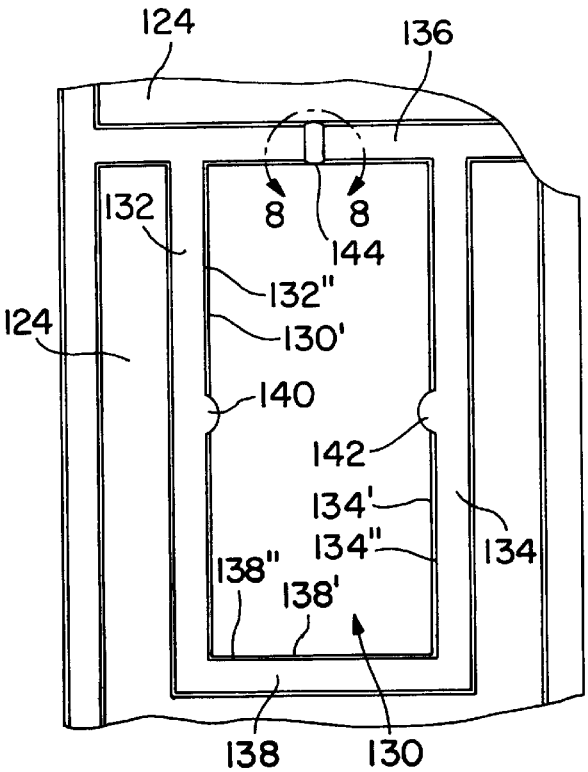
FIG. 7 is an enlarged view of a portion of the structure shown in FIG. 6.
Figure 8:
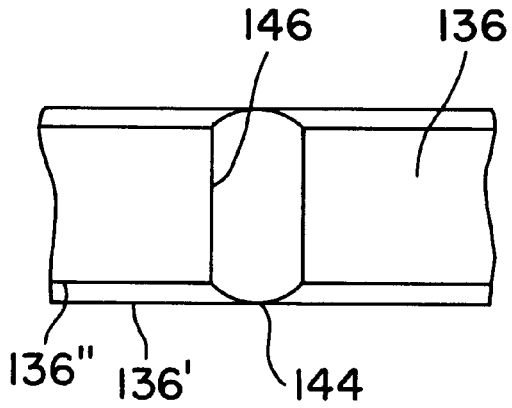
FIG. 8 is an enlarged view of the portion of FIG. 7 indicated by arrow 8—8.
Figure 9:
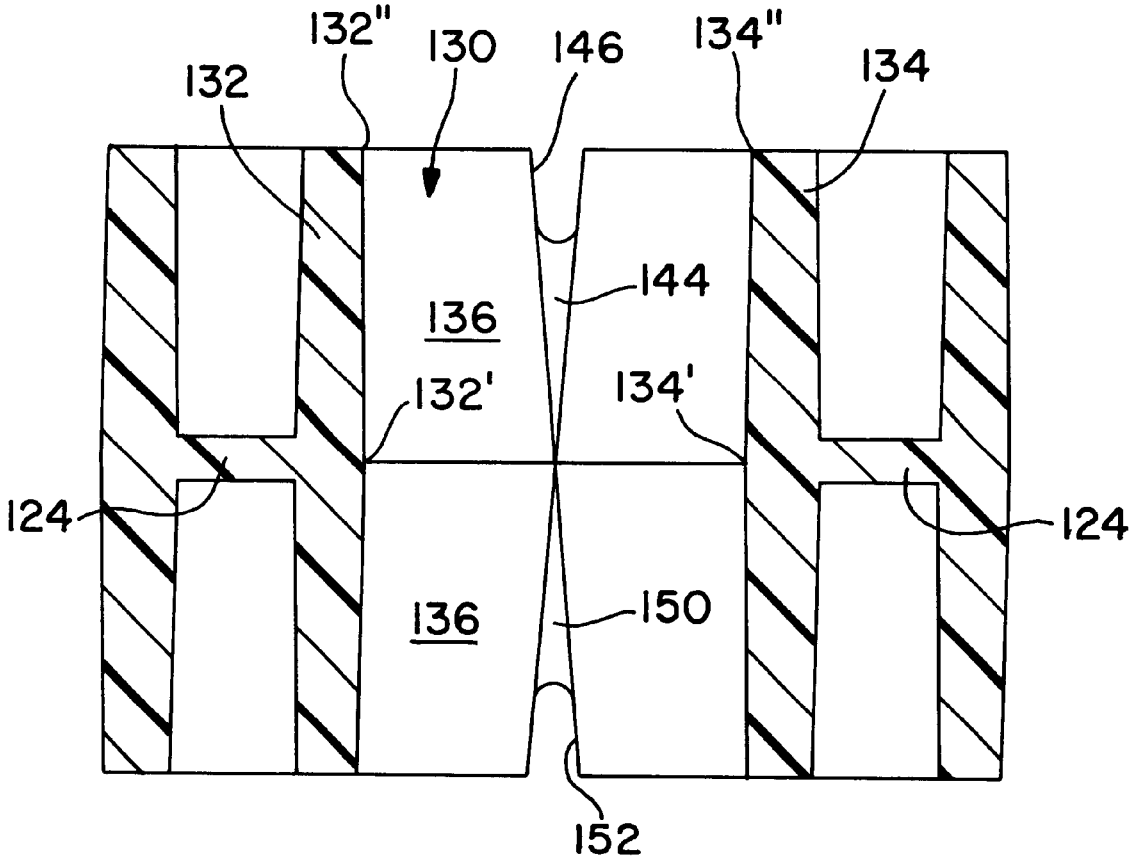
FIG. 9 is an enlarged section taken along line 9—9 of FIG. 6.

A first rectangular hole 130 is defined by walls 132 and 134 which form two long sides of the hole and walls 136 and 138 which define two short sides of the hole. Referring to FIGS. 7 and 9, the face of wall 132 defining a long side of hole 130 intersects the parting line 122 at line 132', and the face of wall 132 has an outer edge at 132". The face of wall 134 defining the other long side of hole 130 intersects the parting line 122 at line 134', and the face of wall 134 has an outer edge at 134". The face of wall 136 defining one short side of hole 130 intersects the parting line 122 at 136', and the face of wall 136 has an outer edge at 136". The face of wall 138 defining other short side of hole 130 intersects the parting line 122 at 138', and the face of wall 138 has an outer edge at 138".

As seen in FIG. 9, the construction of hole 130 is symmetrical on opposite sides of parting line 122, and the hole tapers from given dimensions at the parting line which is midway between opposite ends of hole 130 to greater dimensions at the opposite ends of the hole to define draft for molding or casting purposes.

Referring to FIG. 6, a first rib 140 is disposed on one of the long sides of hole 130 as defined by the inner face of wall 132, rib 140 projecting into the hole and extending generally parallel with a longitudinal axis extending through the hole. Therefore, rib 140 has zero draft. A second rib 142 is disposed on the other of the long sides of hole 130 as defined by the inner face of wall 134. Rib 142 projects into hole 130 and extends generally parallel with a longitudinal axis extending through the hole. Therefore, rib 142 has zero draft. A third rib 144 as shown in FIG. 9, is disposed on one short side of hole 130 as defined by the inner face of wall 136. Rib 144 projects into hole 130 and extends generally parallel with a longitudinal axis extending through the hole. Therefore, rib 144 has zero draft. Each of ribs 140, 142 and 144 is disposed at the midpoint of the associated side of hole 130.

Rib 144 extends from parting line 122 toward the upper edge of wall 136 as seen in FIG. 9 and tapers to a wider dimension toward such upper edge. An opening 146 is formed in the upper edge of wall 136 and extends through rib 144. Opening 146 serves the same purpose as opening 84 in the previous embodiment. A screw or other fastening means may therefore be inserted through opening 146 and into a piece of lumber received in the hole for fastening the rigid body and the piece of lumber to one another.

A fourth rib 150 is also disposed on wall 136 and is a mirror image of rib 144. An opening 152 is formed in the lower edge of wall 136 as seen in FIG. 9 and extends through rib 150. Opening 152 is adapted to receive a screw or other fastening means for fastening the rigid body to a piece of lumber. It should be understood that additional ribs (not shown) corresponding to ribs 140 and 142 and forming mirror images thereof will be provided in alignment with ribs 140 and 142. These additional ribs will extend from parting line 122 to the lower edge of wall 136 as seen in FIG. 9.

The three ribs 140, 142 and 144 provided in hole 130 operate in the same manner as the ribs provided in holes 40 and 42 and serve to properly align pieces of lumber inserted in hole 130. Ribs aligned with ribs 140, 142 and 144 on the other side of parting line 122 serve a similar purpose. Another hole 160 is defined by walls 162, 164, 166 and 168, the construction being substantially identical to that previously described in connection with hole 130. Three ribs are formed in hole 160 corresponding to ribs 140, 142 and 144 of hole 130, two of such ribs 170 and 172 being visible in FIG. 6. An opening 176 in wall 166 is similar to hole 146 previously described and serves the same purpose. Hole 160 is also symmetrical on opposite sides of parting line 122.

A piece of lumber 180 is indicated in broken lines in FIG. 6 and is illustrated as extending through hole 160. Such a piece of lumber is automatically properly aligned with the rigid body 120 so as to extend substantially perpendicular thereto. The piece of lumber is then fastened to the body by screws or other suitable fastening means.

The nominal dimensions of a conventional 2×4 piece of lumber are 1.50 inches and 3.50 inches. In a typical example, the two ribs on the long sides of a hole are spaced from one another about 1.535 inches while the rib on the short side of the hole is spaced from the wall at the opposite short side of the hole about 3.75 inches. In this manner, a 2×4 has a nominal dimension between the long sides thereof which is slightly less than the distance between the first and second ribs of the hole, while the 2×4 has a nominal dimension between the short sides thereof which is slightly less than the distance between the third rib and the other of the short sides of the hole.

The invention has been described with reference to a preferred embodiment. Obviously, various modifications, alternatives and other embodiments will occur to others upon reading and understanding this specification. It is my/our intention to include all such modifications, alternatives and other embodiments insofar as they come within the scope of the appended claims or equivalents thereof.

What is claimed is:

1. A structural member with aligning means for a mating part comprising, a rigid body of hard material, a hole formed in said body for receiving a mating part formed of a material softer than the material of said body, said hole having a generally rectangular cross-section including two long sides and two short sides, said hole having a longitudinal axis, said hole having only one rib on each of said long sides and only one rib on one of said short sides, the other of said short sides being free of a rib, each of said ribs projecting into said hole and extending generally parallel with said axis, thereby defining three ribs within the hole for engaging a mating part received in said hole to provide a three-point contact with a mating part, each of said ribs being disposed substantially at the midpoint of the associated side of the hole, and an opening formed in said body in communication with said hole for receiving fastening means for fastening said body to a mating part received in said hole.

2. A structural member as defined in claim 1 wherein said opening is formed through said rib on said one of said short sides of the hole.

3. A structural member as defined in claim 1 including additional openings formed in said body and in communication with said hole for receiving further fastening means to provide support for the structural member.

4. A structural member as defined in claim 1 wherein said body has a top surface and a bottom edge, said hole extending through the body from said top surface to said bottom edge whereby the hole has opposite open ends.

5. A structural member as defined in claim 1 wherein said body has a second hole formed in said body, said second hole being of a construction similar to the construction of said first-mentioned hole.

6. In combination, a structural member and a piece of lumber having a substantially rectangular cross-section including a pair of opposite long sides and a pair of opposite short sides, said structural member comprising, a rigid body of hard material, a hole formed in said body receiving said piece of lumber which is formed of a material softer than the material of said body, said hole having a generally rectangular cross-section including two long sides and two short sides, said hole having a longitudinal axis, said hole having only one rib on each of said long sides and only one rib on one of said short sides, the other of said short sides being free of a rib, each of said ribs projecting into said hole and extending generally parallel with said axis, thereby defining three ribs within the hole engaging said piece of lumber disposed within said hole to provide a three-point contact with said piece of lumber, each of said ribs being disposed substantially at the midpoint of the associated side of the hole, an opening formed in said body in communication with said hole, and fastening means extending through said opening and into said piece of lumber for fastening said body to said piece of lumber.

7. The combination as defined in claim 6 wherein said piece of lumber has a nominal dimension between the long sides thereof which is slightly less than the distance between said first and second ribs, and a nominal dimension between the short sides thereof which is slightly less than the distance between the rib on said one of said short sides and the other of said short sides of the hole.

8. The combination as defined in claim 6 wherein said opening is formed through said rib on said one of said short sides of the hole.

* * * * *